United States Patent [19]

Willett

[11] Patent Number: 4,958,952

[45] Date of Patent: Sep. 25, 1990

[54] CABLE SECURING DEVICE

[76] Inventor: Lance G. Willett, 12407 Kathryn St., Maple Ridge, British Columbia, Canada, V2X 8X8

[21] Appl. No.: 413,126

[22] Filed: Sep. 27, 1989

[51] Int. Cl.[5] ..... B41J 1/54; B41J 3/36; B41B 27/26; A47F 7/00

[52] U.S. Cl. ..... 401/131; 401/52; 401/88; 401/195; 211/69.1

[58] Field of Search ..... 401/131, 88, 195, 52; 211/69.1–69.9

[56] References Cited

U.S. PATENT DOCUMENTS

| | | | |
|---|---|---|---|
| 832,401 | 10/1906 | Martin . | |
| 1,889,738 | 11/1932 | Nelson | 401/52 |
| 2,268,598 | 1/1942 | Kellems . | |
| 3,570,284 | 3/1971 | Hendricks . | |
| 3,638,987 | 2/1972 | Fidrych . | |
| 3,999,253 | 12/1976 | Hoadley . | |
| 4,055,875 | 11/1977 | Strickland . | |
| 4,291,809 | 9/1981 | Lyon | 211/69.5 |
| 4,354,705 | 10/1982 | Shorey et al. . | |
| 4,368,910 | 1/1983 | Fidrych . | |
| 4,699,536 | 10/1987 | Berman | 401/88 |

FOREIGN PATENT DOCUMENTS

| | | | |
|---|---|---|---|
| 0280837 | 9/1988 | European Pat. Off. | 401/88 |

OTHER PUBLICATIONS

"Your ROLAMECH Pen Owner's Manual".

KELLERS TM Utility/Contractor Catalog Relating to Flexible Wire Mesh Holding Devices.

*Primary Examiner*—Mickey Yu

*Assistant Examiner*—Kerry Owens

*Attorney, Agent, or Firm*—Shlesinger & Myers

[57] ABSTRACT

A cable securing device for removably securing a cable to a base fixture including a cylindrical plug connected to one end of the cable and a wire mesh grip secured within a hole in the base for grippingly engaging the plug. A release key is provided for releasing the grip. The use of the device to secure a pen to a pen and base set is described.

10 Claims, 2 Drawing Sheets

CABLE SECURING DEVICE

FIELD TO THE INVENTION

This invention relates to devices for securing a cable to a base fixture.

BACKGROUND OF THE INVENTION

Occasions frequently arise when it is desirable to secure relatively small articles (for example, pens) against loss or theft, but doing so in a way which still permits the article to be used. A common way of doing this is to secure the article to one end of a flexible cable—the other end being secured to a fixed base. One example, as it pertains to the securing of pens, may be found in U.S. Pat. No. 4,699,536 granted to Berman on Oct. 13, 1987. However, in this example, it does not appear that there is any easy way of releasing the pen once it is secured—other than by cutting the connecting cable or by disassembling the base fixture.

A wide variety of securing devices, including relatively bulky chains, locks, anchor mechanisms and the like are used from time-to-time to secure movable or portable articles. However, many of these devices are relatively large or bulky, and not particularly well suited for the purpose of securing smaller articles.

Accordingly, it is an object of the present invention to provide a new and improved device for securing a cable to a fixed base, particularly a cable which is relatively small in diameter.

A further object of the present invention is to provide a new and improved device for securing a cable to a fixed base with a simple key mechanism that may be used to subsequently release the cable from the base.

SUMMARY OF THE INVENTION

In accordance with a broad aspect of the present invention, there is provided a device for removably securing a cable to a base fixture, the device comprising an elongated cylindrical plug and means connecting same to one end of the cable, and a wire mesh grip secured within a cylindrical hole extending into the base. The grip is sized within the hole to longitudinally receive and grippingly engage the plug when the latter is inserted into the hole. Further, the device includes a release key having an elongated tubular wall sized to slide longitudinally over the plug within the hole while pushing the wire mesh grip backwardly over the plug. The result is to release the grip on the plug.

It should be noted here that wire mesh grips are well known, commercially available devices that come in a variety of configurations and sizes. They are frequently used in industry to support or hold flexible lines such as insulated electrical cable. However, in the context of the present invention, it should be noted that wire mesh grip does not grip the cable directly. Rather, it grips the cylindrical plug connected to one end of the cable and which will typically have a diameter significantly greater than that of the cable to provide a relatively large surface area that can be gripped. The cable itself may have a small diameter that cannot be easily held by a wire mesh grip but which is commensurate in size with a relatively small object such as a pen fitted at the other end of the cable. However, despite a small diameter, the cable can be made very strong if made from flexible stainless steel or the like.

To secure a cable with the device of the present invention, one merely inserts the plug into the base fixture. The wire mesh grip then assumes a strong positive grip on the plug. However, this grip may be readily defeated by using the release key to push the wire mesh grip backwardly over the surface of the plug. The plug may then be manually drawn from the hole. Preferably, a biasing means such as a spring is provided within the hole to urge the plug from the hole when the grip is released.

The foregoing and other feature and advantages of the present invention will now be described with reference to the drawings.

DETAILED DESCRIPTION

Figure 1:
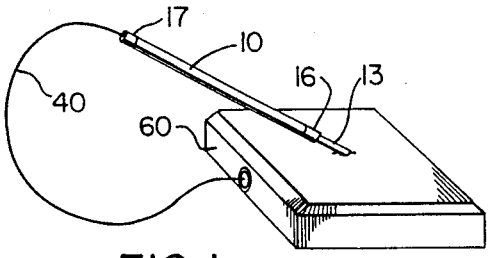
FIG. 1 is a general perspective view of a pen and pen base set, the pen being connected to a cable secured to the base fixture in accordance with the present invention.
Figure 2:
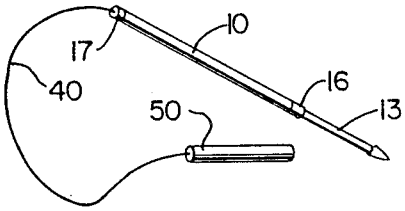
FIG. 2 is a perspective view showing the pen and connecting cable of FIG. 1 when not secured to the base fixture.

The pen and base set shown in the Figures comprises a pen 10, a securing cable 40 to which the pen is connected at one end, and a base fixture 60. As best seen in FIG. 2, a cylindrical plug 50 is connected to the end of cable 40 opposite to that of the pen. Normally, the base fixture will itself be fixedly attached to some other structure such as a table or counter top. However, as will become apparent, the features carried within the base fixture for the purpose of securing the cable could equally be built within some larger retaining structure such as a table or counter top (which would then be regarded as the base fixture).

Figure 3:
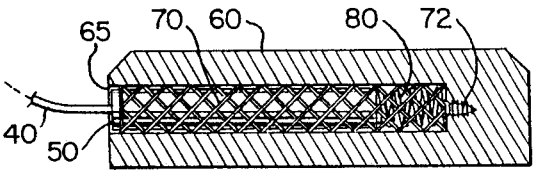
FIG. 3 is a section elevation view of the base fixture in FIG. 1.

The features of base 60 are best illustrated in FIG. 3. These include an elongated cylindrical hole 65 bored into the base, a wire mesh grip 70 secured within the hole, and a spring 80 seated at the base of the hole. Grip 70 is secured in hole 65 by screw 72, and is sized to longitudinally receive and grippingly engage plug 50 when the plug is inserted into the hole as shown in FIG. 3. Typically, hole 65 may have a depth of about 4 inches and a diameter of about ½ inch, while plug 50 may have a diameter of about ⅜ inches. With such sizing, B.D.S. 25 U Wire Puller available from Enconomy Cable Grip Co. of Norwalk, Conn., and serving as wire mesh grip 70, was found to provide a strong, positive grip on the plug; the plug itself being fabricated from stainless steel.

Figure 4:
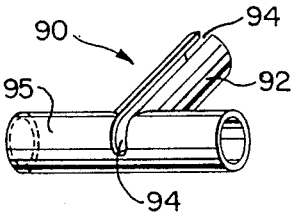
FIG. 4 is a perspective view a release key for releasing the cable from the base fixture of FIG. 1.
Figure 5A:
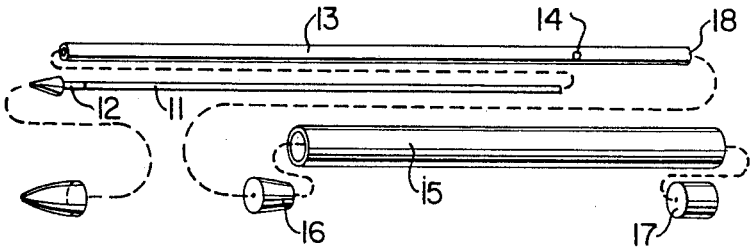
FIG. 5 is an exploded view, partially cut away, of the pen, connecting cable and plug shown in FIG. 2.
Figure 5B:
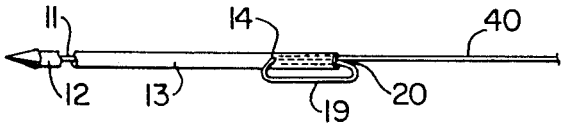
Figure 5C:
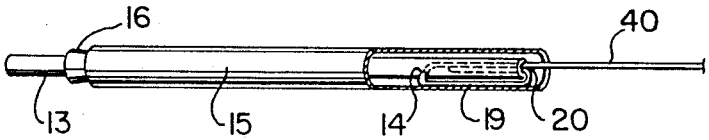
Figure 5D:
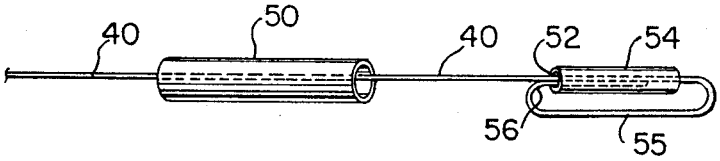

As illustrated in FIG. 3, plug 50 is gripped within hole 65 by wire mesh grip 70. However, this grip can readily be defeated by T-shaped release key 90 illustrated in FIG. 4. Release key 90 is fabricated from plastic tubing and includes an elongated tubular wall 92 sized for sliding longitudinally over plug 50 within hole 65 while pushing wire mesh grip 70 backwardly over the plug to the point where the wire mesh grip loses its grip. In other words, when inserted into hole 65 tubular wall 92 slides in the annular space between plug 50 and the wall of hole 65 which is occupied by wire mesh grip 70. This compresses and bunches the wire mesh grip away from the surface of plug 50.

When the grip provided by wire mesh grip 70 is lost, spring 80 which is in compression in the position shown in FIG. 3 will act in a convenient way to urge plug 50 outwardly from hole 65.

Tubular wall 92 includes an elongated slot 94, the latter of which is sized to allow passage of the diameter of cable 40. This allows key 90 to be passed over cable 40 and to be moved into position for the purpose of releasing plug 50. For the convenience of a user, key 90 also includes a handle portion 95.

Cable 40 may be fabricated from various suitable materials. To provide a cable which is very flexible yet durable and difficult to cut with conventional tools, one material that may be used is stainless steel aircraft cable having a diameter of about 1/16 inch substantially less than that of plug 50. The ease of linking such wire to plug 50 at one end and to pen 10 at the opposed end is illustrated in FIG. 5.

FIG. 5 (an exploded view) illustrates the mechanism by means of which cable 40 is connected to plug 50. As can be seen, cable 40 extends into open end 52 of a cylindrical tube 54, then loops back at 55 along the outer wall of tube 54. Then, at 56, cable 40 extends once again into tube 54. When cable 40 is pulled to the left in FIG. 5, plug 50 being held in place, tube 54 is drawn into the plug, the looping back portion of cable 40 enabling a force fit of the tube within the plug. To achieve such a fit, the inner diameter of plug 50 obviously has to be sized bearing in mind the outer diameter of tube 54 and the diameter of cable 40. A particularly strong force fit can be achieved is plug 50 is made from aluminum and the toleranced fit is such that some deformation occurs as tube 54 is drawn into the plug.

FIG. 5 also illustrates a construction for pen 10 that connects with cable 40 in much the same way as plug 50. Pen 10 comprises a conventional ink cartridge 11 with a pen point 12. The cartridge fits longitudinally within a lower pen barrel portion or cylindrical tube 13, such barrel including a hole 14 in its side wall. Lower pen barrel portion 13 partially telescopes into cylindrical upper pen barrel portion 15 through tapered ring 16, the latter of which provides a wedge lock between the two barrel portions. A cap 17 including an axial hole (not shown) through which cable 40 extends, fits over the end of upper barrel portion 15 opposite to the end where ring 16 is wedged. As can be seen, cable 40 extends into open end 18 of lower barrel portion 13, then passes through hole 14, then loops back at 19 between the outer wall of lower barrel portion 13 and the inner wall of upper barrel portion 15. Then, at 20, cable 40 extends once again into open end 18. From the exploded view, the entire pen construction assembly may be drawn tightly and securely connected to cable 40.

While the present invention is considered particularly suitable and convenient for the purpose of securing a pen to a pen base, and while it has been described with reference to such an application, it will be understood that a cable and base fixture device as described could be used to secure a great variety of articles other than pens. Further, it will be readily apparent to those skilled in the art that various modifications and variations to the structures that have been described with reference to the drawing are possible without departing from the spirit and scope of the claims which follow.

I claim:

1. An assembly for removably securing a cable to a base fixture, said assembly comprising:

(a) an elongated cylindrical plug and means for connecting same to one end of said cable;

(b) a wire mesh grip secured within a cylindrical hole extending into said base, said grip being sized within said hole for longitudinally receiving and grippingly engaging said plug; and, (c) a release key having an elongated tubular wall sized for sliding longitudinally over said plug within said hole while pushing said wire mesh grip backwardly over said plug for releasing the grip of said wire mesh grip on said plug.

2. A securing device as described in claim 1, the tubular wall of said key having a longitudinal slot permitting passage of said cable.

3. A securing device as described in claim 2, including biasing means in said hole for urging said plug from said hole when the grip of said wire mesh grip on said plug is released.

4. A securing device as described in claim 3, said biasing means comprising a spring seated at the base of said hole, said spring being compressed by said plug when said plug is inserted into said hole.

5. A securing device as described in claim 1, wherein said connecting means comprises a cylindrical tube, said cable extending into an open end of said tube, then looping back within said plug along the outer wall of said tube, then extending again into said end of said tube.

6. A pen and pen base set, comprising:

(a) a pen and means connecting same to one end of a securing cable;

(b) an elongated cylindrical plug and means connecting same to an opposed end of said cable;

(c) a wire mesh grip secured within a cylindrical hole extending into said base, said grip being sized within said hole for longitudinally receiving and grippingly engaging said plug; and, (d) a release key having an elongated tubular wall sized for sliding longitudinally over said plug within said hole while pushing said wire mesh grip backwardly over said plug for releasing the grip of said wire mesh grip on said plug.

7. A pen and pen base set as described in claim 6, the tubular wall of said key having a longitudinal slot permitting passage of said cable.

8. A pen and pen base set as described in claim 7, including biasing means in said hole for urging said plug from said hole when the grip of said wire mesh grip on said plug is released.

9. A pen and pen base set as described in claim 8, said biasing means comprising a spring seated at the base of said hole, said spring being compressed by said plug when said plug is inserted into said hole.

10. A pen and base set as described in claim 6, wherein said means connecting said plug to said cable comprises a cylindrical tube, said cable extending into an open end of said tube, then looping back within said plug along the outer wall of said tube, then extending again into said end of said tube.

* * * * *